US005984140A

United States Patent [19]

Amron

[11] Patent Number: 5,984,140

[45] Date of Patent: Nov. 16, 1999

[54] WEIGHT & SPRING ASSISTED PUMPING ACTUATOR FOR FLUID PRESSURIZATION

[76] Inventor: Scott Amron, 77 Horton Pl., Syosset, N.Y. 11791

[21] Appl. No.: 09/245,639

[22] Filed: Feb. 8, 1999

Related U.S. Application Data

[63] Continuation-in-part of application No. 09/240,471, Jan. 31, 1999.

[51] Int. Cl.[6] ..... B05B 9/00; B65D 83/14

[52] U.S. Cl. ..... 222/79; 222/401

[58] Field of Search ..... 222/79, 401

[56] References Cited

U.S. PATENT DOCUMENTS

| | | | |
|---|---|---|---|
| 3,995,779 | 12/1976 | Mizzi | 222/401 |
| 4,147,284 | 4/1979 | Mizzi | 222/401 |
| 5,074,437 | 12/1991 | D'Andrade et al. | 222/79 |
| 5,184,756 | 2/1993 | Amron | 222/79 |
| 5,267,674 | 12/1993 | Von Schuckmann | 222/401 X |
| 5,348,197 | 9/1994 | Mizzi et al. | 222/401 |
| 5,348,198 | 9/1994 | Mizzi et al. | 222/401 |

*Primary Examiner*—Kevin P. Shaver
*Attorney, Agent, or Firm*—Brian Dinicola, Esq.

[57] ABSTRACT

A weight and spring assisted actuating assembly for pressuring, with air, a liquid in a tank includes a reciprocating piston that is freely movable with a charging compartment. Appropriate manipulation of the charging compartment or, if applicable, the housing within which it is disposed, results in movement of the piston and causes outside air to enter the charging compartment and, subsequently, to exhaust into the tank to thereby pressurize the contents thereof. In accordance with an especially advantageous application of the actuating assembly, an air pressurized toy water gun is realized by ejecting air from the charging compartment into the water containing tank of the water gun.

17 Claims, 4 Drawing Sheets

WEIGHT & SPRING ASSISTED PUMPING ACTUATOR FOR FLUID PRESSURIZATION

REFERENCE TO RELATED APPLICATION

This application is a continuation-in-part of patent application Ser. No. 09/240,471 filed on Jan. 31, 1999 by Scott Amron and entitled WEIGHT ASSISTED PUMPING ACTUATOR FOR FLUID PRESSURIZATION.

BACKGROUND OF THE INVENTION

1. Field of the Invention

The present invention is directed to a self contained means of pressurizing a fluid reservoir with air, creating a pressure differential between the contained fluid and the ambient atmosphere that propels fluid from, for example, a water ejecting toy gun or a dispensing container in either a continuous stream or in a selective manner.

2. Discussion of the Prior Art

Water guns have for decades been a very popular child's toy. Since the toy industry is very competitive, hundreds of different style water guns have been developed in an attempt to profit from the toy's inherent popularity. The most traditional forms of water guns are activated by a manual pumping action through the trigger. While such pump action water guns work, they are limited in the distance the water traveled, the amount of water projected and the duration of the pumping cycle. In an attempt to improve upon water guns, the toy industry has developed pressure activated water guns. Such pressure activated water guns work upon the principle of pressure differentials between the water held within the toy and the atmosphere. The water within the toy is subjected to a pressure higher than that of the ambient air. As a result, when the water within the toy is given an avenue of escape, the water will stream out under pressure.

Two primary types of pressure activated water toys exist. The first type is when the water itself is worked to a pressure higher than that of the ambient air. This type of water gun is exemplified by the following: U.S. Pat. No. 3,197,070 to Curtis F. Pearl et al, shows a water gun activated by trapping water in a collapsible area. As the device is collapsed, the pressure of the water builds, spraying the water out of the one small orifice left within the pressured area. Once the confined area is fully collapsed, the reexpansion of the area draws forth more water from a reservoir, thus priming the water gun for another cycle. U.S. Pat. No. 4,854,480 to Robert S. Shindo and U.S. Pat. No. 4,735,239 to Michael E. Salmon et al, both show toy water devices that use an elastic bladder to pressurize water. The bladders are filled with high pressure water, and the bladders respond by elastically deforming. The source of pressurized water is then removed and the water within the expanded bladder is held in place by a clamping device activated by a trigger. The water gun is used by selectively releasing the clamp, allowing the water to flow from the expanded bladder.

The second type of pressure activated water toys are toys that use air pressure to force water through squirt channels. Such toys that use this technology are exemplified by U.S. Pat. No. 4,214,674 to Jones et al. The Jones patent shows a two piece apparatus consisting of a pressurized water reservoir and a discharging gun. The Jones patent has a hand operated air pump. By way of additional example, U.S. Pat. No. 4,239,129 to Gary F. Esposito describes a water pistol and/or flashlight structure which includes a reciprocal pump within a liquid chamber or tank located itself within the gun housing. Like the pump employed by Jones et al, the pump of Esposito is a hand operated structure used to pressurize air within the tank after water has been added, and a trigger is used for subsequent release of the water. Battery operated lights and sound are also provided.

A primary disadvantage of the water guns employing a hand operated actuator to achieve pressurization is just that, they require the child to suspend play, spend a substantial amount of time operating the actuator, and then resuming play. It would therefore be highly desirable to provide a water gun in which the act of pressurizing the water tank closely does not require suspension of play or but actually becomes an exciting and enjoyable aspect of play.

In other fluid dispensing fields, there are even more compelling reasons for the availability of a simple, yet efficient manually operable pressurizing actuator. Specifically the use of chlorofluorocarbons (CFCs) and other flammable and or chemical pressurizing agents, though known to be harmful to the environment, are still in wide spread use.

SUMMARY OF THE INVENTION

The aforementioned deficiencies are overcome, and an advance is made in the art, by a self-contained, weight and spring assisted means of pressurizing a fluid to be dispensed with air. The weight and spring assisted pressurization actuator includes a reciprocating, freely movable piston which is moved within a charging compartment by appropriate manipulation of the housing within which or to which the actuator is attached. A configuration of valves responsive to movements of the piston regulates the introduction of air into the charging compartment and subsequent ejection of this air into the water tank. In accordance with an especially preferred embodiment, one or more springs are interposed between each end of the piston and the charging compartment.

Although the weight and spring assisted actuator of the present invention is especially advantageous and useful in connection with toy water guns, other uses such, for example, as pressurized spray cans and the like, are also contemplated. The actuating mechanism itself comprises a charging compartment defining an interior cavity, and first and second openings in fluid communication with the interior cavity. The piston disposed within the interior cavity, is freely movable in response to movement of the charging compartment. A first valve associated with the first opening is responsive to movement of the piston in a first direction to prevent fluid communication between the interior cavity and first opening and responsive to movement of the piston in the opposite direction to establish fluid communication between the interior cavity and the first opening. A second valve associated with the second opening is responsive to movement of the piston in the first direction to establish fluid communication between the interior cavity and second opening and responsive to movement of the piston in the second direction to prevent fluid communication between the interior cavity and the second opening. Movement of the piston in the first direction pushes air from within the charging compartment through the second opening for delivery to a container containing liquid to be pressurized (e.g., the water storage reservoir of a toy water gun) and movement of the piston in the second direction causes replacement air to flow through the first opening into the charging compartment.

BRIEF DESCRIPTION OF THE DRAWINGS

The invention will be more fully understood by referring to the following detailed specifications, the above specification and the claims set forth herein, when taken in connection with the drawings appended hereto, wherein:

DETAILED DESCRIPTION OF THE INVENTION

Figure 1A:
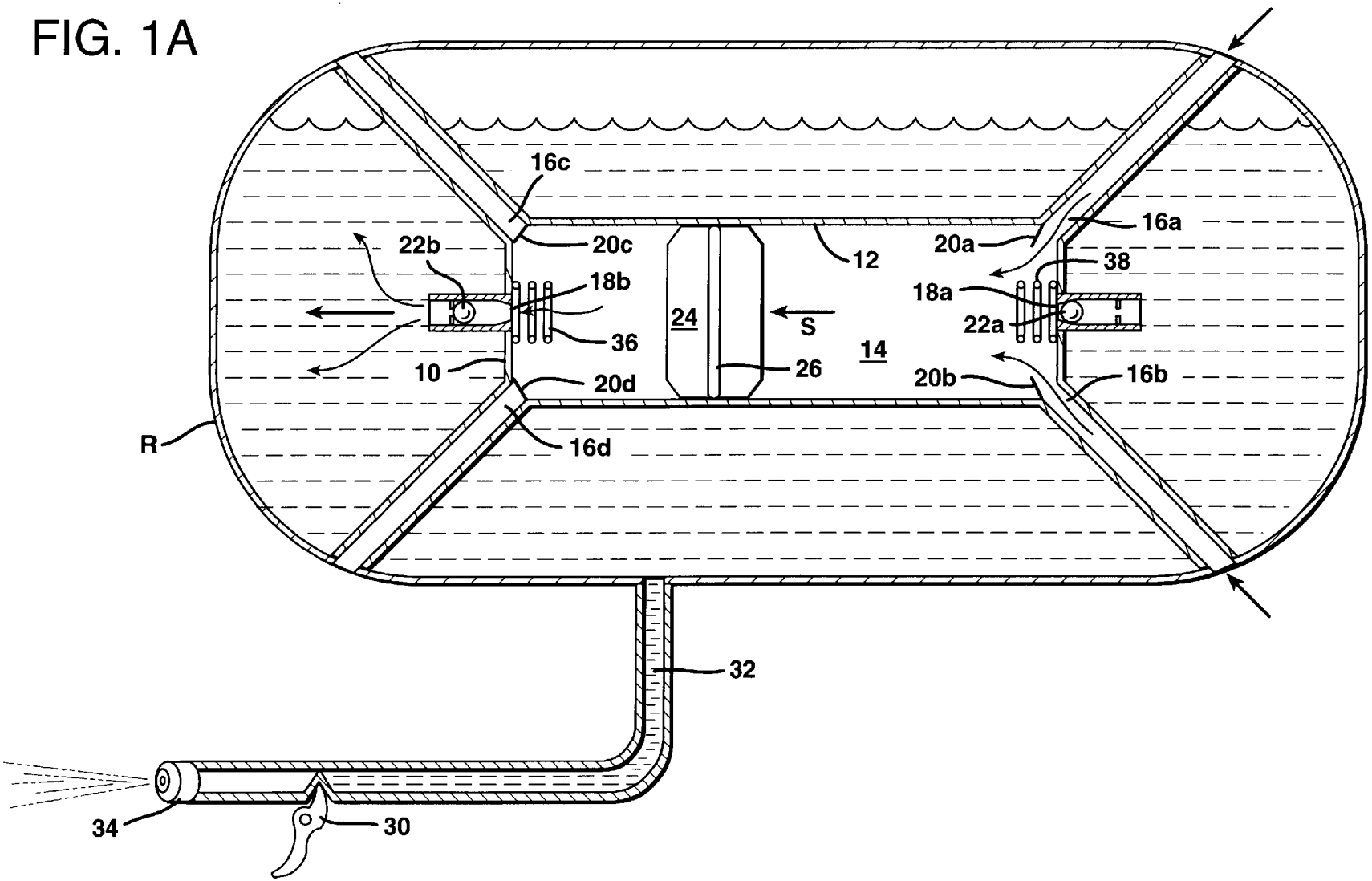
FIG. 1A shows the top view of an illustrative embodiment of a weight assisted pumping actuator constructed in accordance with the present invention.

The present invention is, as mentioned, directed toward a weight assisted pump actuator for pressurizing a fluid such, for example, as water and propelling the fluid through a nozzle. In the discussion of the drawings which follows, in which like elements are represented by like reference numerals throughout the several views, certain illustrative applications of the invention are presented—more specifically, those of toy water guns and fluid dispensing containers. It should, however, be emphasized that the actuator of the present invention may be used in any situation where a fluid storage compartment is disposed within a housing small enough to be comfortably manipulated by hand and in which an alternative is desired to manual operation of a reciprocating pump or to chemical agents which are harmful to the environment.

In any event, and with initial reference to FIG. 1A, there is shown a weight assisted pump actuating mechanism constructed in accordance with an illustrative embodiment of the present invention. In the illustrative embodiment of FIG. 1A, pump actuating mechanism 10 is disposed within a fluid storage container or reservoir R and comprises a charging compartment 12 defining an interior cavity 14, air inlet orifices or openings 16*a*–16*d* for establishing fluid communication between interior cavity 14 and the ambient atmosphere, and air ejection orifices or openings 18*a* and 18*b* for establishing fluid communication between interior cavity 14 and the interior of fluid storage reservoir R.

With continued reference to FIG. 1A, it will be seen that the flow of air through air inlet openings 16*a*–16*d* and air ejection openings 18*a* and 18*b* is respectively regulated by a corresponding one-way valve. In the illustrative configuration depicted in FIG. 1A, flutter valves 20*a*–20*d* are disposed within openings 16*a*–16*d* respectively, while ball valves 22*a* and 22*b* are disposed within openings 18*a* and 18*b*, respectively. The purpose of the aforementioned one-way valves, as will be readily appreciated by those skilled in the art, is to accommodate the charging of cavity 14 with air and, thereafter, the transfer of such air into the reservoir for pressurization of the contents therein.

Figure 1B:
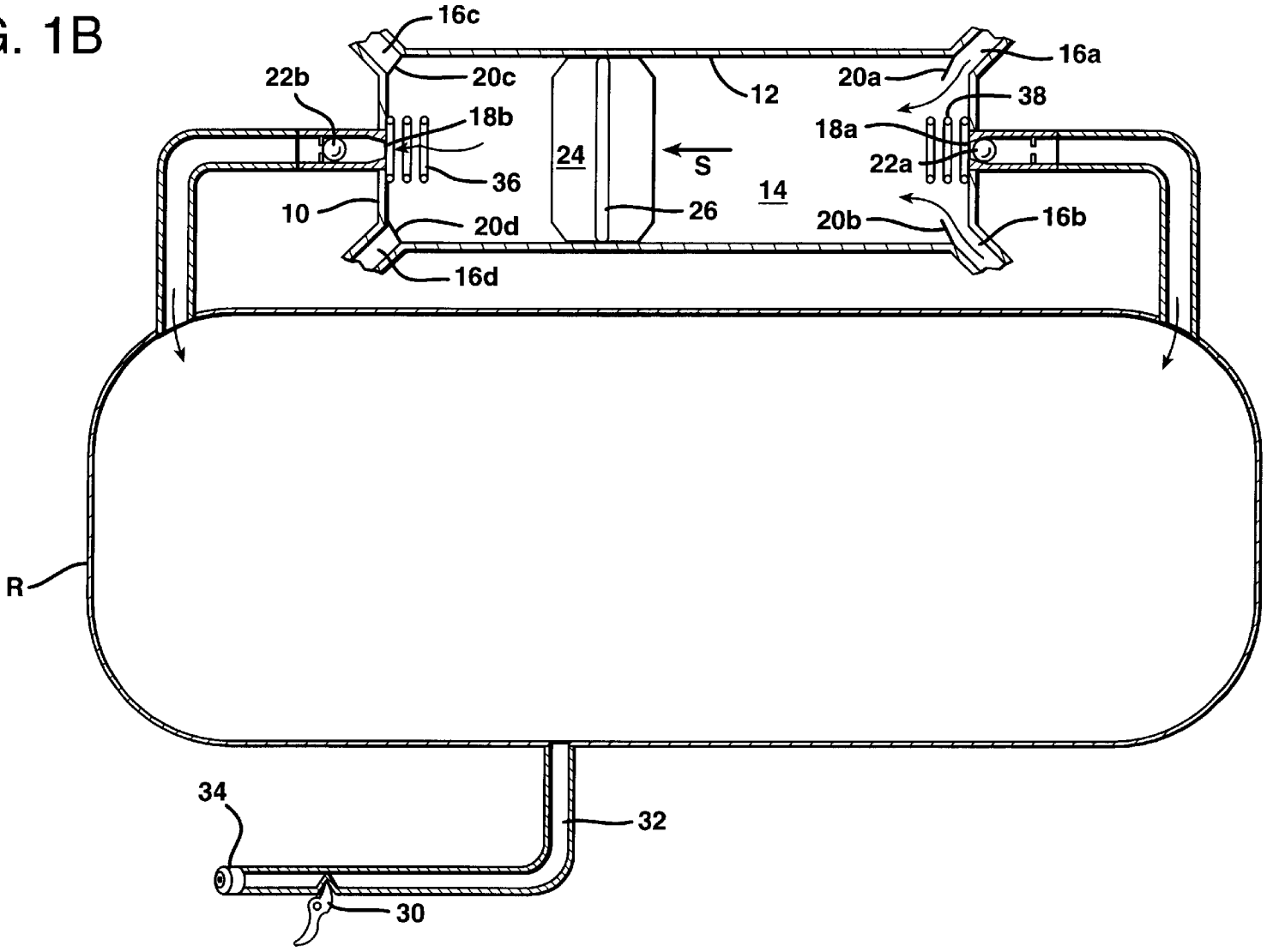
FIG. 1B shows the top view of an alternate embodiment of a weight assisted pumping actuator, specifically mounted at a location external to the fluid storage container to be pressurized.

Before proceeding with a discussion of the weight-assisted actuation aspect of the present invention, it should be noted that the number and types of valves utilized in the configuration of FIG. 1A is subject to variety of modification and substitutions. Moreover, although an arrangement is shown in FIG. 1A wherein the pump actuating mechanism 10 is physically located within the fluid containing reservoir R, alternate configurations, such as that shown in FIG. 1B, in which the pump actuating mechanism is located external to the reservoir R, are also contemplated. In that regard, it should be readily appreciated by those skilled in the art that a network of conduits or hoses for establishing fluid communication between, on the one hand, the ambient environment, and on the other hand, the interior of reservoir R, would easily enable such an arrangement to be effectuated.

In any event, and with continued reference to FIG. 1A, it will be seen that the means by which air is both drawn into interior cavity 14 and ejected therefrom into reservoir R takes the form of a reciprocating piston 24. Specifically, the inventor herein has recognized that a freely movable piston of sufficient mass, when caused to move in a reciprocating path by an arcuate motion of the compartment within which it is disposed, (or to which it is coupled) can be used to effectively charge and discharge a sufficient volume of air as to pressurize the water storage reservoir of a water gun or other fluid ejecting structure. In the illustrative embodiment of FIG. 1A, a double acting pump is realized by providing inlet and outlet orifices and associated valves at opposite ends of a cylindrically shaped compartment.

When piston 24 moves in the direction of arrow S, one way valves 20*c*, 20*d*, and 22*a* are caused to shut, and valves 20*a*, 20*b*, and 22*b* are caused to open. This causes air in front of piston 24 to flow through opening 18*b*, past valve 22*b*, and into reservoir R. A sealing member or members such, for example, as the elastomeric O-ring 26 shown in FIG. 1A, may be included to prevent pressurized air from escaping behind piston 24. During this same portion of piston travel, replacement air is drawn through openings 16*a* and 16*b*, past open one-way valves 20*a* and 20*b* into the area of cavity 14 behind piston 24. Movement of the piston 24 in the opposite direction produces an identical result by operation of the respective one-way valves. At such time as the contents of reservoir are suitably pressurized, a release mechanism such as trigger 30 is manipulated to allow liquid to flow through avenue of release 32 and nozzle 34. Spring members 36 and 38 are preferably interposed between the ends of piston 24 and opposite interior walls of the charging compartment in order to absorb excess energy in the piston and apply this additional kinetic energy to each piston stroke.

Figure 2:
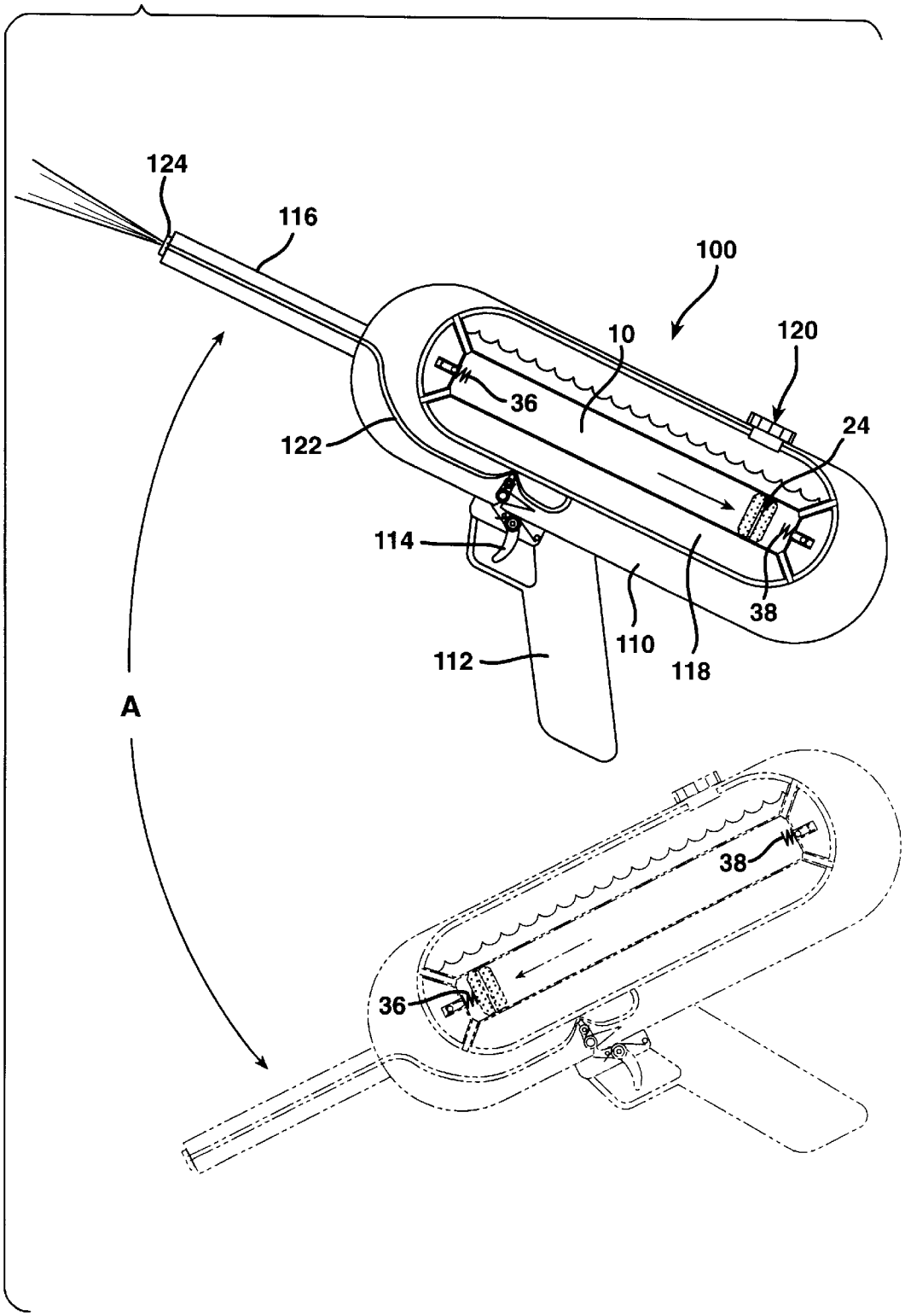
FIG. 2 depicts a toy water gun employing the weight assisted pumping actuator of FIG. 1A, solid and dotted line representations are included to show the manner in which the water gun may be manipulated during play to charge a water storage reservoir with air.

Turning now to FIG. 2, there is shown a toy water gun 100 constructed in accordance with the teachings of the present invention. In the illustrative arrangement shown in FIG. 2, the weight assisted actuating mechanism 10 is disposed with the water storage reservoir of gun 100, which gun includes a housing 110, an extended handle 112 connected to the housing, a trigger 114 located on the housing adjacent handle 112, a barrel portion 116 of the housing extending outwardly away from handle 112, and a water storage reservoir 118 attached to housing 110. The reservoir 118 has a fill port and fill cap 120 and opens into an elongated avenue of release 122 for water displaced by pressurized air. As seen in FIG. 2, the avenue of release extends from the reservoir runs the length of barrel 116. A nozzle 124 is disposed at the end of the barrel and is connected to the avenue of release 116.

The operation of a toy water gun constructed in accordance with the present invention will be readily apparent upon comparison of the solid and dotted line representations of gun 100 in FIG. 2. Swinging of gun 100 in an upward direction along arcuate path A causes weighted piston to move toward the rear of the charging compartment of actuated mechanism 10. Air ahead of the piston 24 is pushed into reservior 118, while at the same time air is drawn into the charging compartment in the region behind the piston 24. Downward movement of gun 100 along arcuate path A produces an identical result in that air ahead of the piston, which was previously drawn during the last stroke, is now discharged into reservoir 118 while new air is drawn in behind the piston 24 to replace that which was ejected during the previous stroke.

Figure 3:
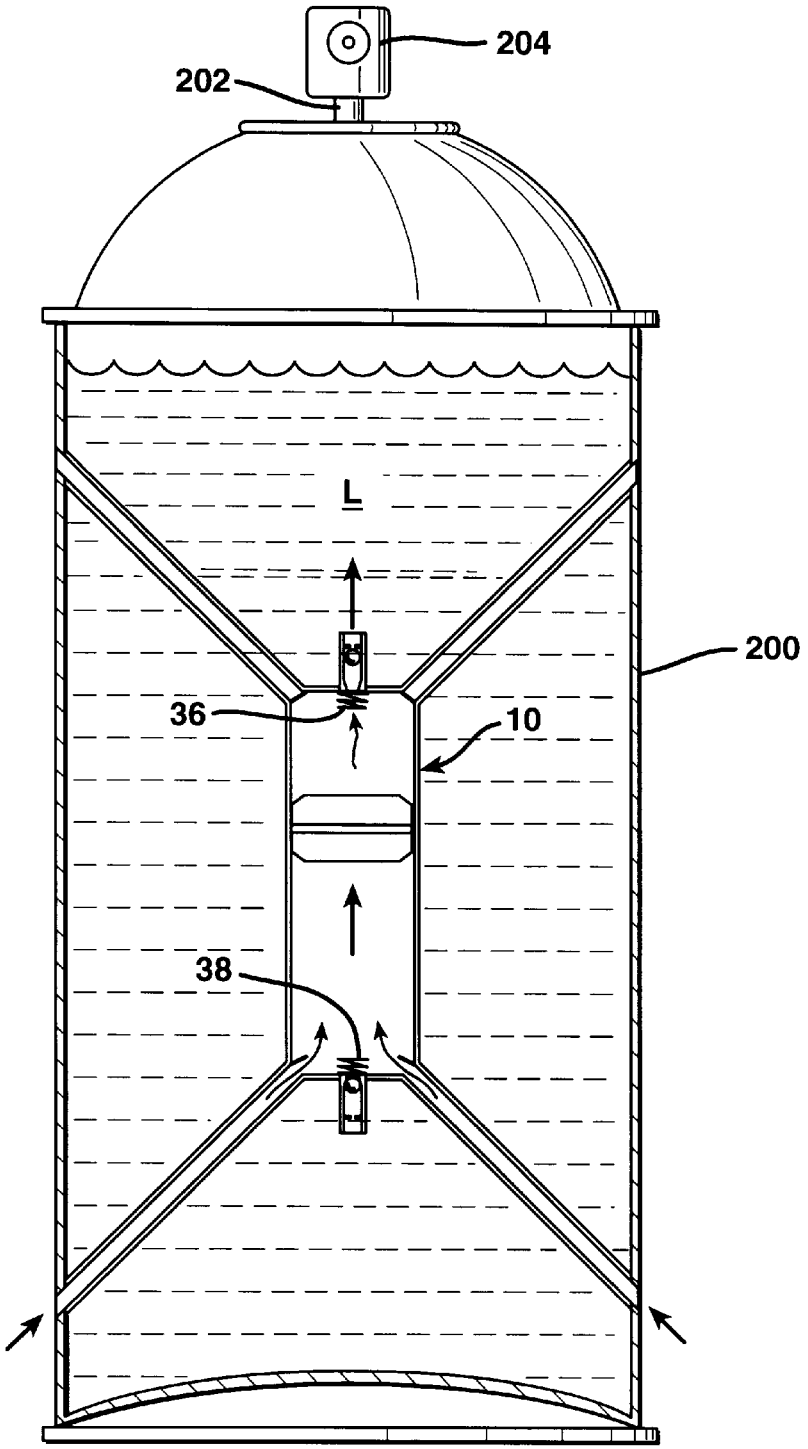
FIG. 3 depicts the interior construction of a dispensing container which employs a weight assisted pumping actuator according to the present invention in order to pressurize the contents thereof.

With reference now to FIG. 3, there is shown yet another application of the weight assisted pump actuator of the present invention. In the embodiment of FIG. 3, a spray can 200 is depicted having an interior cavity containing a liquid to be dispensed L as well as the weight assisted actuating mechanism 10 of the present invention, disposed an alternate embodiment of the present invention. Operation is in all matters identical to that discussed above, except that the avenue of release comprises a thin tube 202 at the top of can 200 and a push button nozzle 204.

In view of the foregoing description, it should now be understood that although the invention described within the above specification shows non-limiting examples of the present invention, the weight assisted pumping actuator of the present invention may be employed in a varied of hand operated liquid dispensing devices.

What is claimed is:

1. A self contained actuating mechanism for use in pressurizing, with air, a liquid within a container to be ejected under pressure, the actuating mechanism comprising:

a charging compartment defining an interior cavity, and first and second openings in fluid communication with the interior cavity;

a piston disposed within the interior cavity, said piston being freely movable within the interior cavity in response to movement of the charging compartment;

at least one spring interposed between the piston and an interior sidewall of the charging compartment;

a first valve associated with the first opening, said first valve being responsive to movement, in a first direction, of said piston to prevent air communication between the interior cavity and first opening and responsive to movement, in a second direction opposite the first direction, of said piston to establish air communication between the interior cavity and the first opening; and a second valve associated with the second opening, said second valve being responsive to movement, in said first direction, of said piston to establish air communication between the interior cavity and second opening and responsive to movement, in said second direction, of said piston to prevent air communication between the interior cavity and the second opening, whereby movement of the piston in said first direction pushes air from within the charging compartment through the second opening for delivery to a container containing liquid to be pressurized and movement of the piston in said second direction causes replacement air to flow into the charging compartment.

2. The actuating mechanism of claim 1, wherein said first valve is a flap valve.

3. The actuating mechanism of claim 1, wherein the second valve is a ball valve.

4. The actuating mechanism of claim 1, wherein the first and second openings are defined at opposite ends of said charging compartment.

5. The actuating mechanism of claim 1, wherein said charging compartment further defines third and fourth openings in fluid communication with the interior cavity, and third and fourth valves associated with the first and second openings, respectively.

6. The actuating mechanism of claim 5, wherein said first and second openings redisposed at a first end of said charging compartment and said third and fourth openings are disposed at a second end of said charging compartment.

7. The actuating mechanism of claim 6, wherein said third valve is responsive to movement of said piston in said second direction to prevent air communication between the interior cavity and the third opening and responsive to movement of said piston in said first direction to establish air communication between the interior cavity and the fourth opening; and wherein said fourth valve is responsive to movement of said piston in said second direction to establish air communication between the interior cavity and the fourth opening and responsive to movement of said piston in said first direction to prevent air communication between the interior cavity and the fourth opening.

8. The actuating mechanism of claim 7, further including a fluid sealing member interposed between an exterior surface of said piston and in interior surface of said charging compartment.

9. A self contained actuating mechanism for use in pressurizing, with air, a liquid within a container to be ejected under pressure, the actuating mechanism comprising:

a charging compartment defining an interior cavity;

a piston disposed within the interior cavity, said piston being freely movable within the interior cavity in response to movement of the charging compartment;

valve means in air communication with said charging compartment for controllably introducing and displacing air from within the charging compartment in response to movement of said piston; and at least one spring interposed between an interior sidewall of the charging compartment and the piston, whereby movement of the piston in a first direction pushes air from within the charging compartment through the valve means for delivery to a container containing liquid to be pressurized and movement of the piston in a second direction opposite the first direction causes replacement air to flow through the valve means into the charging compartment.

10. A self-contained, air pressurized toy water gun, which comprises:

a housing;

an extended handle connected to said housing;

a trigger located on said housing adjacent said handle;

a barrel portion of said housing extending outwardly away from said handle;

at least one water storage reservoir attached to said housing, said reservoir having a fill port;

a self contained actuating mechanism for use in pressurizing, with air, water within the water storage reservoir, the actuating mechanism including a charging compartment defining an interior cavity;

a piston disposed with the interior cavity, said piston being freely movable within the interior cavity in response to movement of the charging compartment;

valve means in air communication with said charging compartment for controllably introducing and displacing air from within the charging compartment in response to movement of said piston; and at least one spring interposed between said piston and an interior sidewall of the charging compartment, whereby movement of the piston in a first direction pushes air from within the charging compartment through the valve means for delivery to the water storage reservoir and movement of the piston in a second direction opposite the first direction causes replacement air to flow through the valve means into the charging compartment;

an elongated avenue of release for water displaced by said pressurized air, said avenue of release extending from the reservoir running the length of said barrel; and a nozzle at the end of said barrel, said nozzle being connected to said avenue of release.

11. A self-contained, air pressured dispenser, which comprises:

a housing defining an interior chamber for receiving a fluid to be pressurized;

a self contained actuating mechanism associated with the housing for use in pressurizing, with air, air within the interior chamber, the actuating mechanism including a charging compartment defining an interior cavity;

a piston disposed within the interior cavity, said piston being freely movable within the interior cavity in response to movement of the charging compartment;

at least one spring interposed between said piston and an interior sidewall of the charging compartment; and valve means in air communication with said charging compartment for controllably introducing and displacing air from within the charging compartment in response to movement of said piston, whereby movement of the piston in a first direction pushes air from within the charging compartment through the valve means for delivery to the interior chamber and movement of the piston in a second direction opposite the first direction causes replacement air to flow through the valve means into the charging compartment;

an avenue of release for liquid displaced by said pressurized air, nozzle means; and means for selectively establishing liquid communication between the nozzle means and the avenue of release.

12. The dispenser of claim 11, wherein the charging compartment defines first and second openings in liquid communication with the interior cavity; and wherein said valve means comprises a first valve associated with the first opening, said first valve being responsive to movement, in a first direction, of said piston to prevent air communication between the interior cavity and first opening and responsive to movement, in a second direction opposite the first direction, of said piston to establish air communication between the interior cavity and the first opening; and a second valve associated with the second opening, said second valve being responsive to movement, in said first direction, of said piston to establish air communication between the interior cavity and second opening and responsive to movement, in said second direction, of said piston to prevent air communication between the interior cavity and the second opening, whereby movement of the piston in said first direction pushes air from within the charging compartment through the second opening for delivery to the fluid storage reservoir and movement of the piston in said second direction causes replacement air to flow through the first opening into the charging compartment.

13. The dispenser of claim 12, wherein said first valve is a flap valve.

14. The dispenser of claim 12, wherein said second valve is a ball valve.

15. The dispenser of claim 12, wherein the first and second openings are defined at opposite ends of said charging compartment.

16. The dispenser of claim 11, wherein the charging compartment is disposed within the interior chamber of the housing.

17. The dispenser of claim 11, wherein a first spring is interposed between a first end of the piston and a sidewall of the interior cavity and a second spring is interposed between a second end of the piston and a sidewall of the interior cavity.

* * * * *